United States Patent [19]

Guinomet et al.

[11] 4,152,916

[45] May 8, 1979

[54] METHOD OF PROCESSING STEEL STRIP USING A ROLLING OIL EMULSION CONTAINING $SiO_2$ AS A STABILIZED SILICIC ACID SOL

[75] Inventors: Yves Guinomet, Waltrop; Ulrich Tenhaven; Wilhelm Wrede, both of Dortmund; Rudolf Schoenemann, Adenau; Wolfgang Friedemann, Neuss; Heinz Groschopp, Düsseldorf; Hans G. Germscheid, Hösel, all of Fed. Rep. of Germany

[73] Assignee: Henkel Kommanditgesellschaft auf Aktien (Henkel KGaA), Düsseldorf-Holthausen, Fed. Rep. of Germany

[21] Appl. No.: 802,788

[22] Filed: Jun. 2, 1977

[30] Foreign Application Priority Data

Jun. 4, 1976 [DE] Fed. Rep. of Germany ..... 2625105

[51] Int. Cl.[2] ..... B21B 45/02

[52] U.S. Cl. ..... 72/42; 148/12.1

[58] Field of Search ..... 72/42, 46; 148/12.1; 252/28; 427/178

[56] References Cited

U.S. PATENT DOCUMENTS

| | | | |
|---|---|---|---|
| 2,796,364 | 6/1957 | Suchoff | 148/12.1 X |
| 3,454,495 | 7/1969 | Schneider | 252/28 X |
| 3,582,407 | 6/1971 | Steger et al. | 148/12.1 X |
| 3,700,506 | 10/1972 | Tanaka et al. | 148/12.1 X |
| 3,725,140 | 4/1973 | Patula et al. | 148/12.1 |

*Primary Examiner*—E. M. Combs

*Attorney, Agent, or Firm*—Hammond & Littell

[57] ABSTRACT

A method for processing steel strip, which comprises cold-rolling the steel strip, coiling the rolled steel strip and annealing the coiled steel strip, wherein a rolling oil emulsion containing 0.1 to 5 percent by weight of $SiO_2$ in the form of stabilized silicic acid sol and having a pH value between 5.0 and 9.0 is applied to the steel strip prior to coiling and the rolling oil emulsion so employed.

12 Claims, No Drawings

METHOD OF PROCESSING STEEL STRIP USING A ROLLING OIL EMULSION CONTAINING $SIO_2$ AS A STABILIZED SILICIC ACID SOL

THE PRIOR ART

It has long been known, during the cold-rolling of steel strip, to provide the steel strip with a rolling oil emulsion, preferably based on mineral oil, and, after the rolling and coiling operation, to anneal the steel strip while coiled. With this mode of operation, it is difficult to avoid a certain amount of sticking or welding (so-called "stickers") of the coiled steel strips during box annealing.

In the event that a cleaning operation is effected between the rolling operation and box annealing, for example when manufacturing super-finished strip, so-called "stickers" can be largely prevented by means of alkaline cleaners containing silicate. However, this additional working step is normally not effected in the case of strips rolled with mineral oil. Furthermore, tests have shown that alkaline cleaners containing silicate cannot be added to the rolling oil emulsions in a technically feasible operation.

OBJECTS OF THE INVENTION

An object of the invention is the development of a method for the processing of steel strip which avoids the disadvantage of welding in the box annealing furnace, said method providing for the cold-rolling of steel strip which is coiled after the rolling operation and is subsequently annealed while coiled, without the above-mentioned sticking together or welding (so-called "stickers") of turns during annealing of the steel coils.

Another object of the invention is the development of a method for processing steel strip which comprises cold-rolling the steel strip, coiling the rolled steel strip and annealing the coiled strip, where prior to coiling a rolling oil emulsion which contains 0.1 to 5 percent by weight $SiO_2$ in the form of stabilized silicic acid sol and has a pH value between 5.0 and 9.0 is applied to the steel strip.

Another object of the invention is the development of a method for processing steel strip which comprises cold-rolling the steel strip, coiling the rolled steel strip and annealing the coiled steel strip, where during a cold-rolling operation prior to coiling, a rolling oil emulsion which contains 0.1 to 5 percent by weight of $SiO_2$ in the form of stabilized silicic acid sol and has a pH value between 5.0 and 9.0 is applied to the steel strip.

A further object of the invention is the development of a rolling oil emulsion which contains 0.1 to 5 percent by weight of $SiO_2$ in the form of stabilized silicic acid sol and which has a pH value between 5.0 and 9.0, which emulsion can be applied to a steel strip prior to its coiling and annealing to bring about a marked improvement in the cold-rolling of the steel strip.

A yet further object of the invention is the development of steel strip which is entirely free of or only very slightly marred by undesirable adhesion phenomena.

These and other objects of the invention will become more apparent as the description thereof proceeds.

DESCRIPTION OF THE INVENTION

It has now been found that the above-mentioned disadvantages can be avoided and the above objects can be achieved by a method for processing steel strip which comprises cold-rolling the steel strip, coiling th rolled steel strip and annealing the coiled steel strip, wherein prior to cooling, e.g. during the cold-rolling operation, a rolling oil emulsion which contains 0.1 to 5, preferably 0.3 to 2, percent by weight of $SiO_2$ in the form of stabilized silicic acid sol, and which has a pH value between 5.0 and 9.0 is applied to the steel strip.

The invention also relates to a rolling oil emulsion which contains 0.1 to 5, preferably 0.3 to 2, percent by weight of $SiO_2$ in the form of stabilized silicic acid sol and which has a pH value between 5.0 and 9.0. This stabilized silicic acid sol serves as a component for addition to commercially available rolling oil emulsion products based on mineral oil and emulsifying agents. The methods of preparation and stabilization of the silicic acid sols of the invention are themselves known to those skilled in the art.

More particularly, the invention involves a rolling oil emulsion comprising from 0.1 to 5, preferably from 0.3 to 2, percent by weight of $SiO_2$ in the form of stabilized silicic acid sol and the remainder conventional ingredients present in rolling oil emulsions for steel strip, said emulsion having a pH value between 5.0 and 9.0.

The invention also relates to the use of concentrates of the above-mentioned silicic acid sols and of other conventional ingredients of rolling oil emulsions, such as wetting agents, preferably non-ionic wetting agents, for addition to conventional rolling oil emulsions to be used in the present invention. The invention alternatively relates to compositions comprising concentrates of a conventional rolling oil emulsion, the above-mentioned silicic acid sols, and other optional ingredients, such as wetting agents, preferably non-ionic wetting agents, for use in the process of the present invention.

Commercially available products based on mineral oil, and emulsifying agents, are suitable as rolling oil emulsions to which the silicic acid sols of the present invention can be added. Such commercially available products generally contain 1 to 20 percent by weight of mineral oil and 1 to 25 percent by weight of emulsifying agent, relative to the quantity of mineral oil, and, if required, further additives of natural oils or fats. In many cases, the commercially available products also contain active anionic and/or nonionic wetting agents as well as active antimicrobial substances and, if required, anti-corrosion agents.

The ready-to-use rolling oil emulsions of the invention advantageously comprise an oil emulsion containing from 0.1 to 5, preferably 0.3 to 2, percent by weight of $SiO_2$ in the form of stabilized silicic acid sol and having a pH value between 5.0 and 9.0, 1 to 20 percent by weight of an oil or fat, preferably mineral oil, 1 to 25 percent by weight of emulsifying agent relative to the quantity of mineral oil, and optionally 0.01 to 1 percent by weight of wetting agent and the remainder to 100% of other conventional ingredients present in rolling oil emulsions for steel strip. Very satisfactory results have been realized using a non-ionic wetting agent in the rolling oil emulsions. The other conventional ingredients for rolling oil emulsions are those which are already well known for this purpose, including e.g. the water, various natural oils or fats, anti-corrosion agents, etc. These conventional additives can be added in the customarily effective quantities.

The rolling oil emulsion concentrates of the invention advantageously comprise an oil emulsion containing from 0.1 to 5 percent by weight of $SiO_2$ in the form of stabilized silicic acid sol, 1 to 20 percent by weight of an oil or fat, preferably mineral oil, 1 to 25 percent by weight of emulsifying agent relative to the quantity of mineral oil, and optionally 0.01 to 1 percent by weight of wetting agent, preferably a non-ionic wetting agent, and the remainder to 100% of other conventional ingredients present in rolling oil emulsions for steel strip.

The pH value of the rolling oil emulsion in accordance with the present invention lies between 5.0 and 9.0, preferably between 5.5 and 8.0. Therefore, the silicic acid sols which are used have to be used in a form stabilized in this pH range. Stabilization is effected by methods known per se, chiefly by the addition of aluminum ions, for example in the form of soluble aluminum salts such as aluminum sulfate or an aluminate. The stabilized silicic acid sols used have specific surfaces of 100 to 600 $m^2/g$, preferably 200 to 300 $m^2/g$.

In an advantageous embodiment of the invention, the rolling oil emulsion contains, in addition to the customary content of mineral oil and the above-mentioned content of silicic acid sol, wetting agents in quantities of at least 0.01 to 1 percent by weight, wherein the wetting agents can be added together with the silicic acid sol. Commercially available non-ionic surfactants of the ethoxylated and ethoxylated propoxylated fatty alcohols and/or alkyl phenols and/or fatty amines type, as well as block polymers from propylene oxide and ethylene oxide (molecular weight preferably 1000 to 4000) have proved particularly suitable for the rolling oil emulsions containing silicic acid sols of the present invention. The degree of alkoxylation, e.g. ethoxylation, must always be produced so that water-soluble surfactants or combinations of surfactants are present in the rolling oil emulsions.

The rolling oil emulsion, ready for use, can be produced in a variety of ways. For example, the described silicic acid sol and a wetting agent, preferably the non-ionic surfactants, preferably in the form of concentrates, can be added, collectively or successively, to the conventional rolling oil emulsion. Alternatively, however, a conventional rolling oil emulsion in the form of a concentrate can be added to a prepared solution of stabilized silicic acid sol and wetting agents.

In general, it is advantageous to add the silicic acid sols in a concentrated form, for example with a content of 10 to 30 percent by weight of $SiO_2$ to the rolling oil emulsions. The invention thus also includes a concentrate which comprises a stabilized silicic acid sol, with a content of 5 to 35, preferably 10 to 30, percent by weight of $SiO_2$, 0.01 to 1 percent by weight of wetting agent and optionally other conventional additives for use in the process of the invention. The amounts of such other additives are readily determinable by those of ordinary skill in the art. However, as previously mentioned, the invention also includes an aqueous solution which comprises a stabilized silicic acid sol, a wetting agent and optionally other conventional additives for use in the process of the invention. The concentrations of the various ingredients in such aqueous solution are so chosen that, after the addition of the conventional rolling oil emulsion concentrate, the ready-to-use rolling oil emulsion has the previously described composition. The ready-to-use rolling oil emulsions of the invention are prepared from the concentrates by well-known emulsification methods.

It is normally advantageous to apply the rolling oil emulsion, containing silicic acid sol, in a completely formulated state to the steel strips. Alternatively, however, it is possible to apply the rolling oil emulsion, and a solution of stabilized silicic acid sol also containing, if desired, a wetting agent or agents, separately to the strip, so that the constituents are intermixed on the strip.

Treatment with the rolling oil emulsion containing silicic acid sol can be effected in different ways. Thus, for example, it can be effected during all the rolling passes carried out during the process. However, in many cases it has proved to be sufficient to effect treatment with a rolling oil emulsion, containing silicic acid sol, only during the last rolling pass.

While it is frequently necessary to keep the tension on the coiling reel of the roller stand at a low level, or even to lag the coils in order to prevent the sticking of the steel coils, the reel tension can be kept at a normal level or even increased in the mode of operation in accordance with the present invention, without the occurrence of the undesirable adhesion phenomena previously encountered during the uncoiling operation on the finishing stand.

Thus, the method of the present invention makes it possible, with simple means, to considerably reduce the above-mentioned adhesion phenomena or to avoid them entirely. The prior art disadvantage of welding in the box annealing furnace is unexpectedly avoided in a relatively simple but quite efficient manner when using the method and compositions in accordance with the present invention.

The following examples illustrate the practice of the invention without being limitative in any respect.

EXAMPLES

EXAMPLE 1

6 steel coils each weighing 16 metric tons (t) were rolled in a 5-stand tandem line and, during each rolling pass, were rolled with an emulsion which contained 2 percent by weight of a concentrate of conventional rolling oils (content of mineral oil 15 percent by weight) containing emulsifying agents, 0.01 percent by weight of non-ionic wetting agent (product of addition of 12 moles of ethylene oxide to a $C_{12}$–$C_{18}$ fatty amine) and 0.5 percent by weight of $SiO_2$ in the form of a silicic acid sol stabilized with aluminum ions and having a specific surface of 240 $m^2/g$. The concentration of silicic acid sol was 25 percent by weight of $SiO_2$. The emulsion ready for use had a pH value of 5.7.

The rolled steel strips were coiled with variously graduated reel tensions (3.4,4.4 and 5.4 $kp/mm^2$) and were annealed as a coil under nitrogen/hydrogen gas (HNX gas). These steel strips rolled with emulsion containing silicic acid sol did not show any adhesion phenomena with any of the above reel tensions on the finishing stand. The same reel and annealing conditions were employed with a further 6 steel coils each weighing 16 metric tons (t). However, the rolling oil emulsion was used without an additive of stabilized silicic acid sol and wetting agent. These 6 steel coils did not exhibit any sticking phenomena with a reel tension of 3.4 $kp/mm^2$ although they exhibited sticking phenomena during uncoiling on the finishing stand with reel tensions of 4.4 $kp/mm^2$ and 5.4 $kp/mm^2$.

Samples of all the rolled, annealed and finished steel strips were tested with respect to corrosion behaviour, phosphatability and lacquer adhesion. No differences were observed between the strips rolled with and without an additive of stabilized silicic acid sol.

EXAMPLE 2

3000 metric tons (t) of differing steel materials were rolled in a 5-stand tandem line, wherein only the emulsion used in the last stand contained an additive of 0.1 percent by weight of non-ionic wetting agent (block polymers from propylene oxide and ethylene oxide, molecular weight approximately 2000) and 1.1 percent by weight of $SiO_2$ in the form of a silicic acid sol stabilized with aluminum ions and having a specific surface of 200 $m^2/g$. The concentration of the silicic acid of sol was 20 percent by weight of $SiO_2$. The prepared rolling oil emulsion (content of mineral oil 20 percent by weight) had a pH value of 6.0. The rolled material was unstabilized steel and stabilized steel. The steel coils were subsequently annealed in a box annealing furnace under DX protective gas ($CO_2/CO/N_2/H_2$ gas) and then finished. No formation of sticking could be detected on any of the finished steel coils. All the samples behaved normally with respect to phosphatability, lacquerability and protection against corrosion.

EXAMPLE 3

6 steel coils were rolled in a four-high reversible stand in the same manner as described in Example 1. The rolling oil emulsion, which contained 2 percent by weight of $SiO_2$ in the form of an aluminum-stabilized silicic acid sol (specific surface 300 $m^2/g$), was produced by first adding 0.1 percent by weight of a product of addition of 10 moles ethylene oxide to a $C_{12}$–$C_{18}$ fatty alcohol to the silicic acid sol solution and subsequently adding 2.5 percent by weight of a conventional rolling oil concentrate. The pH value of the finished rolling oil emulsion was 6.4. The results with respect to a tendency to stick, protection against corrosion, phosphatability, and lacquer adhesion corresponded to those given in Example 1.

We claim:

1. In a method for processing steel strip in the presence of a lubricating and anti-sticking composition, which comprises the steps of cold-rolling the steel strip, coiling the rolled steel strip and annealing the coiled steel strip, wherein the improvement comprises applying to said steel strip, prior to coiling, a lubricating and anti-sticking composition consisting essentially of a rolling oil emulsion, containing 0.1 to 5 percent by weight of $SiO_2$ in the form of a stabilized silicic acid sol and having a pH value between 5.0 and 9.0, to thereby prevent any sticking together or welding of the turns of the coiled steel strip during annealing.

2. The method of claim 1 wherein the rolling oil emulsion is applied to the steel strip during the cold-rolling.

3. The method of claim 2, wherein the rolling oil emulsion contains 0.3 to 2 percent by weight of $SiO_2$ in the form of a stabilized silicic acid sol.

4. The method of claim 2, wherein the silicic acid sol is stabilized with aluminum ions.

5. The method of claim 2 wherein the rolling oil emulsion containing silicic acid sol has a pH value between 5.5 and 8.

6. The method of claim 2, wherein the stabilized silicic acid sol has a specific surface of 100 to 600 $m^2/g$.

7. The method of claim 6, wherein the stabilized silicic acid sol has a specific surface of 200 to 300 $m^2/g$.

8. The method of claim 2, wherein the treatment with the rolling oil emulsion containing silicic acid sol is effected during all the rolling passes carried out in the process.

9. The method of claim 2, wherein the treatment with the rolling oil emulsion containing silicic acid sol is effected only during the last rolling pass.

10. The method of claim 2, wherein the rolling oil emulsion, containing silicic acid sol, also contains from 0.01 to 1 percent by weight of non-ionic wetting agent.

11. The method of claim 10, wherein the non-ionic wetting agent is selected from the group consisting of water-soluble ethoxylated or ethoxylated propoxylated fatty alcohols, alkylphenols, fatty amines, any mixtures of these non-ionic wetting agents, and polymers from propylene oxide and ethylene oxide.

12. The method of claim 2, wherein the oil is a mineral oil.

* * * * *